United States Patent [19]

Eary, Sr.

[11] 4,028,754

[45] June 14, 1977

[54] ADJUSTABLE HEAD AND SHOULDER REST

[76] Inventor: George Daniel Eary, Sr., 8 N. Woodlawn Ave., La Vale, Md. 21502

[22] Filed: Dec. 19, 1975

[21] Appl. No.: 642,537

Related U.S. Application Data

[63] Continuation-in-part of Ser. No. 559,009, March 17, 1975.

[52] U.S. Cl. ..... 5/327 B; 297/410

[51] Int. Cl.[2] ..... A47C 21/00

[58] Field of Search ..... 5/327 R, 327 B, 338; 297/410

[56] References Cited

UNITED STATES PATENTS

| | | | |
|---|---|---|---|
| 245,639 | 8/1881 | Lay | 297/410 |
| 3,140,497 | 7/1964 | Carswell | 5/338 |
| 3,608,103 | 9/1971 | Seid | 5/327 B |
| 3,828,377 | 8/1974 | Eary | 5/327 B |
| 3,913,155 | 10/1975 | Eary | 5/327 B |

*Primary Examiner*—Paul R. Gilliam
*Assistant Examiner*—Andrew M. Calvert

[57] ABSTRACT

An adjustable head and shoulder rest is disclosed which is intended for supporting the body while lying face down with the head turned to the right or left at forty five degrees. It is intended as well to support the user's head on an elevated plane while the user is lying on either the right or left side. A head or face rest consisting of two distinctly separate members, one being movable, providing open areas for the eyes, nose and mouth, together with movable right and left shoulder support members permitting adjustment to different body dimensions and allowing proper weight distribution, ease of breathing and body comfort.

4 Claims, 15 Drawing Figures

ADJUSTABLE HEAD AND SHOULDER REST

CROSS REFERENCES TO RELATED INVENTIONS

This application is a continuation-in-part of application Ser. No. 559,009, filed Mar. 17, 1975.

BACKGROUND OF THE INVENTION

1. Field of the Invention

This invention relates to a support for the upper part of the body. More particularly it relates to a device which enables one to lie comfortably face-down with the head to the right or left at 45°, wherein the head and shoulders are cradled in a manner providing for a comfortable distribution of weight and which enables easy, unrestricted breathing. Moreover, it allows the user to lie on either the right or left side comfortably by relieving pressure on the shoulder.

Many individuals have difficulty in sleeping or resting comfortably in a face-down or side position. This may be required during surgery or in post operation recovery. Eithermode of repose is helpful to ladies who have had their hair coiffured and who wish to preserve the results of their visit to the beauty parlor as long as possible. Likewise, sleeping face-down would avoid any discomfort due to the presence of hair curlers. In addition, sunbathers will find this invention useful.

2. Description of Prior Art

A number of devices have been patented which are stated to enable one to lie face-down in comfort. While these devices do enable one to lie face-down in a greater degree of comfort than than they would have in their absence, they are either not adjustable to take care of differing body dimensions or the desires of the user, or are adjustable in a limited manner, or else do not properly support the head and shoulders in the best possible manner.

SUMMARY OF THE INVENTION

This invention consists of a base support having attached thereto a pair of spaced apart resilient shoulder supports which may be adjusted laterally and longitudinally relative to each other and to the base support, allowing the distance between the base support and the shoulder supports to be varied. Fastened to the base and spaced longitudinally from the shoulder supports and equidistant therefrom is a resilient face support consisting of two separate rests, one moveable, providing open areas for the eyes, nose and mouth. Also, the face support may be tilted about an axis parralel to the base and may be raised and lowered.

DESCRIPTION OF PREFERRED EMBODIMENTS

Figure 1:
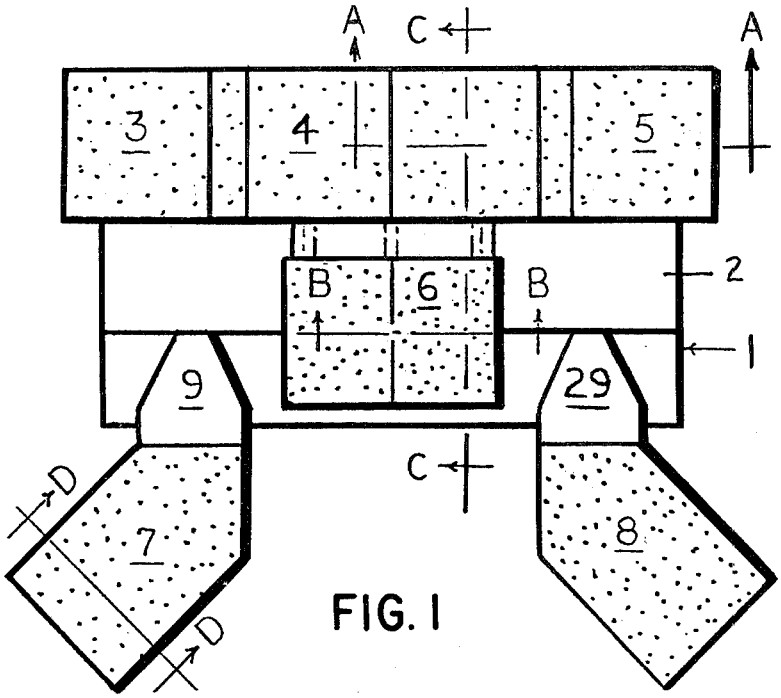
FIG. 1 is a plan view of the body rest.

FIG. 1 shows a head and shoulder rest designated generally as 1, which has a base 2. Base 2 is made of flat and relatively thin material having sufficient rigidity to serve as a support for the head support elements to be attached thereon. Suitable material for this purpose may be aluminum or other sheet metal, plywood, composition board, various resin-fiber glass laminates, etc. Attached to base 2 at it's rearward portion are shoulder rests 7 and 8, attached by members 9 and 29. Near the middle of base 2 are mounted resilient face supports 4 and 6 and fastened to their undersides is a rigid base 26, which may be made of same material as base 2. Members 3 and 5 are protective covers to prevent the user's head from contacting support members 20 and 21, but may also be used for head support when lying on the right or left side. Shoulder rests 7 and 8 as well as face rests 4 and 6 are made from a resilient material such as foam rubber, polyurethane foam or padding for example, and may be covered by cloth or plastic. Alternately, they may be made of inflatable bladders of suitable configuration which can be blown up prior to use. Such bladders may be inflated with air or hot or cold liquids to the desired firmness and temperature. In the accompanying drawings a lower level of dense 100 lb. polyurethane foam and an upper level of 7 lb. polyurethane foam is shown on rests 4, 6, 7 and 8.

Figure 2:
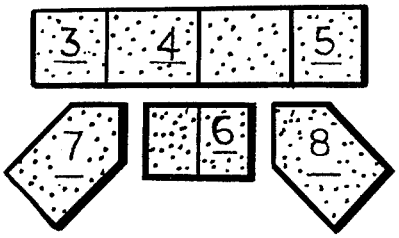
FIG. 2 is a plan view of rests 4, 6, 7 and 8 in their correct relative positions when the user is lying on his or her right or left side.

FIG. 2 is a plan view of rests 4, 6, 7 and 8 showing their correct relative positions for usage by a user who is resting on the right or left side. Rests 4 and 6 are elevated to the desired heighth for the user's maximum comfort.

Figure 3:
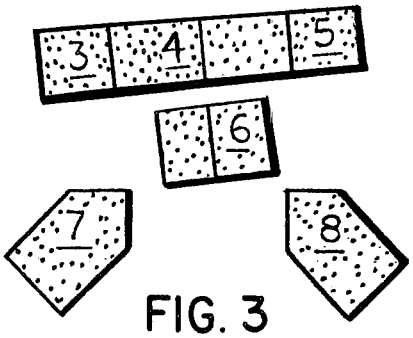
FIG. 3 is a plan view of rests 4, 6, 7 and 8 showing one of innumerable alternate and relative positions of said rests.

FIG. 3 is a plan view of rests 4, 6, 7 and 8 showing one of a near unlimited number of relative positions. Rests 4 and 6 can be rotated forty five degrees clockwise or counterclockwise about a vertical axis. The distance between head rests 4 and 6 and shoulder rests 7 and 8 can also be made greater or smaller simultaneously with the rotational adjustment.

FIGS. 4, 5, 6, 7 and 9 show the members that make up base 2 and demonstrate said longitudinal, latitudinal and rotational adjustment capabilities.

Figure 4:
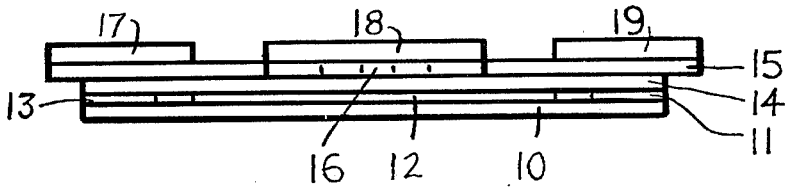
FIG. 4 is an elevation view of laminated layers of base 2.
Figure 5:
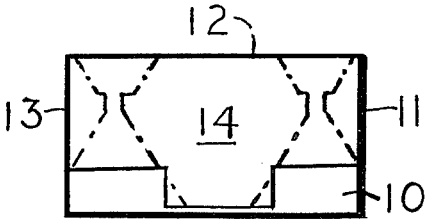
FIGS. 5, 6 and 7 are plan views of laminated layers of base 2.

FIGS. 4 and 5 taken in conjunction show members 10, 11, 12, 13 and 14, each 0.060 inch thick, permanently fastened together becoming one integral part with two hour-glass shaped cavities. Shoulder rest attaching members 9 and 29 shown in FIG. 15 fit these cavities in a manner that allows both longitudinal and latitudinal movement of up to three inches of shoulder rests 7 and 8. The physical size of member 10 is 8½ by 16 inches; members 11, 12 and 13 form a modified T perimeter of 8 by 16 inches; member 14 is 8 by 16 inches and notched at the lower left and right corners to a T shape.

Figure 6:
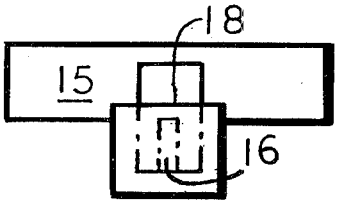

FIG. 6 shows member 15 as a T shape 8 by 18 inches and with a 3 by 6 inches cutout centered within the perimeter. Member 16 is 1 by 3 inches and is permanently fastened to member 14 on the lengthwise center and 1 inch from the lower edge of 14. Shown also is cutout in member 15 surrounding member 16. Member 18 is 5 by 6 inches and is centerally and permanently fastened to member 16. Members 15, 16, 17, 18 and 19 are 0.100 inch thick.

Figure 7:
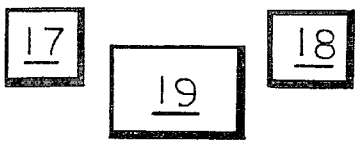

FIG. 7 shows location of 17, 18 and 19 members relative to the remainder of base 2 members. In conjunction with FIG. 9 it now becomes apparent that members 10, 11, 12, 13, 14, 16 and 18 become one permanently integral part. Also members 15, 17 and 19 become a second permanently integral part, moveable relative to each other, but inseparable.

Figure 8:
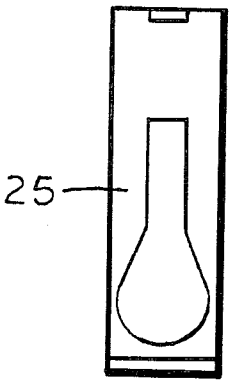
FIG. 8 is a plan view of member 25.

FIG. 8 is a plan view of the keeper, member 25. At the ends there are 90 degree flanges three fourths of an inch long. One is ¼ inches wide and the other is ¾ inches wide. This allows passage of keeper 25 into intended slots in member 20, when unassembled.

In FIGS. 9, 10, 11, 12, 13 and 14 the right hand side only is shown with the left side always typical or opposite.

Figure 9:
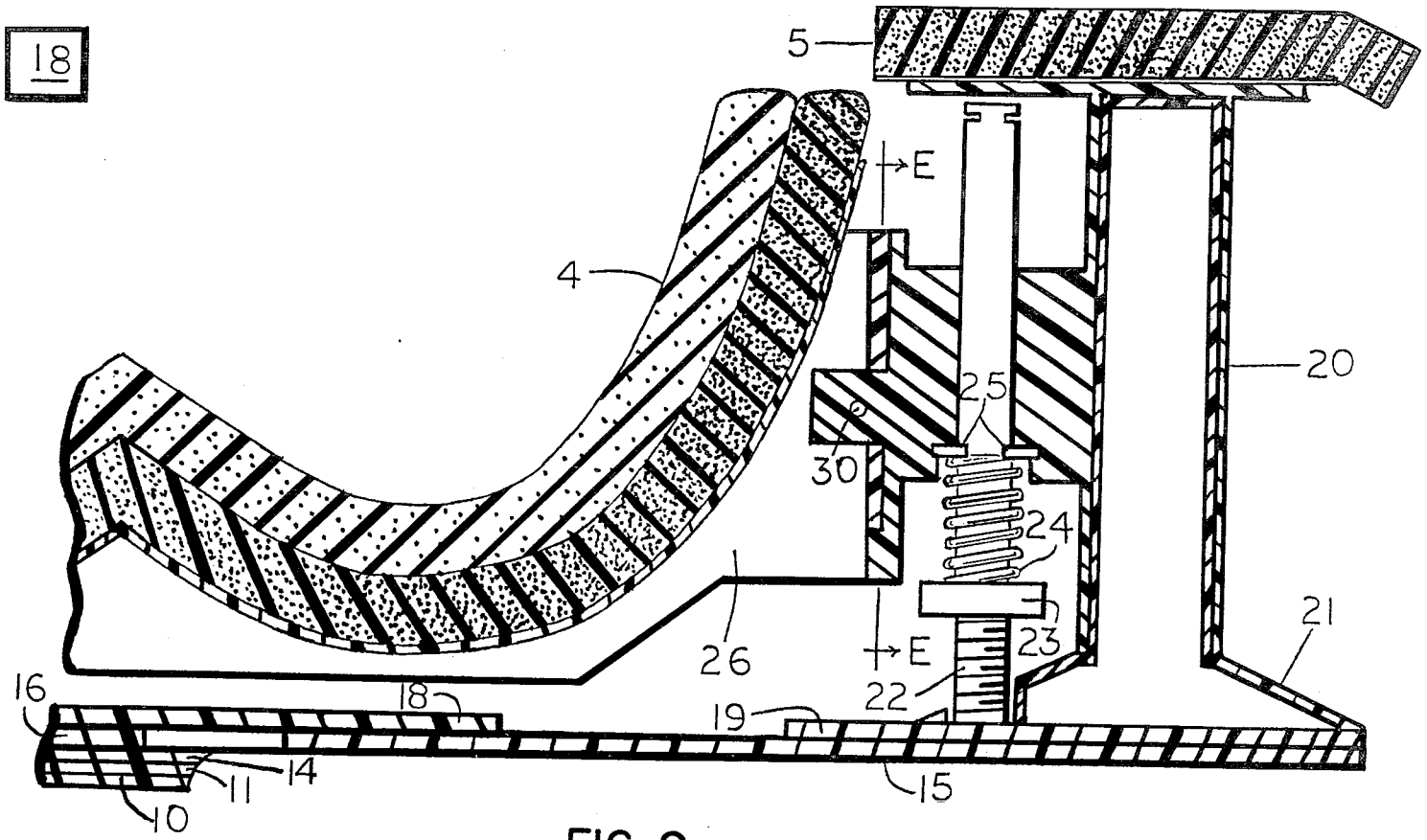
FIG. 9 is a sectional view along line A—A of FIG. 1 showing support structure for head rests 4 and 6.

FIG. 9 is a sectional view along line A—A of FIG. 1 showing attachment of support structures 20, 21 and 26. It is apparent that when a change in elevation of head rests 4 and 6 is desired, movement of keeper 25 to circular area allows spring 24 to exert upward pressure on member 20 which then telescopes upward while being controlled on it's vertical path by stationary member 21. Stud 22 is notched at ½ inches intervals to allow any desired heighth of head rests 4 and 6. Intermediate notches in stud 22 are omitted for clarity. It also is apparent that spring tension can be changed by turning knob 23 which is threaded to lower portion of stud 22. Threads beneath spring 24 not shown. Flanged areas of members 20 and 26 are held in contact by a pin through hole 30.

Figure 10:
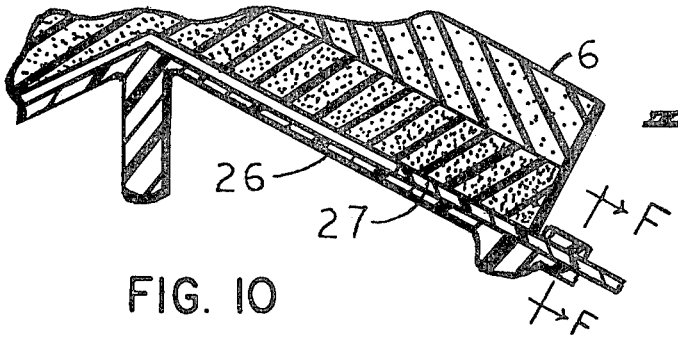
FIG. 10 is a sectional view along line B—B of FIG. 1 showing attachment of lower face rest 6 to support member 26.
Figure 11:
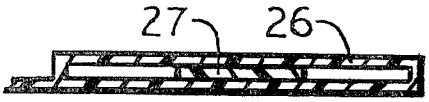
FIG. 11 is a sectional view along line F—F of FIG. 10 showing attachment of lower face rest 6 to support member 26.

FIG. 10 is a sectional view along line B—B of FIG. 1 showing attaching means of head rest 6 to support 26. In conjunction with FIG. 11, it is apparent that as member 27 is fastened to head rest 6 and will freely move relative to support member 26, head rest 6 can be moved closer to or farther from head rest 4.

Figure 12:
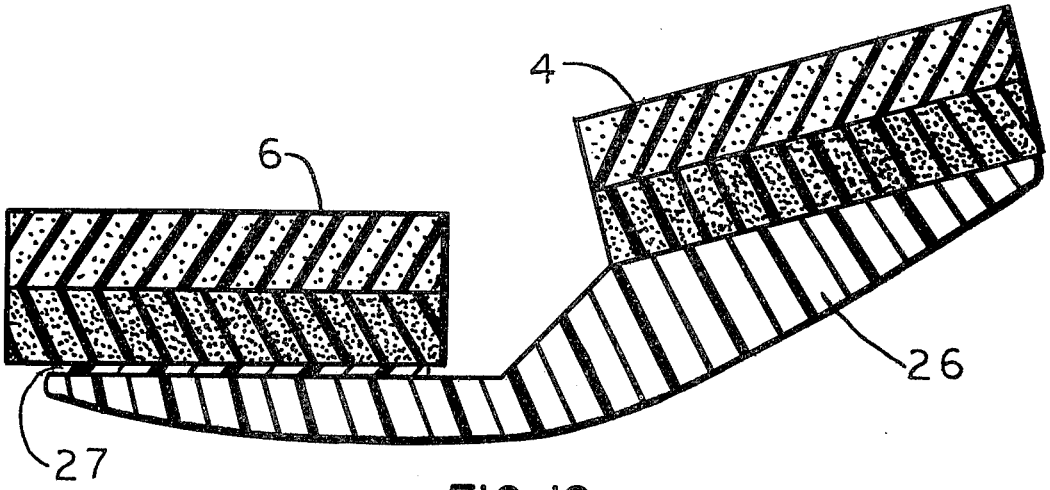
FIG. 12 is a sectional view along line C—C of FIG. 1 showing attachment of rests 4 and 6 to support structure 26.

FIG. 12 is a sectional view along line C—C of FIG. 1 and shows the general configuration of support member 26 strengthening rib. There would be one or two running the length of rest 4 and one large and two smaller strengthening ribs running 90° supporting both rests 4 and 6. All other areas of 26 would be 0.100 thick. FIG. 12 also shows rest 4 as being higher than rest 6 to make more pressure on the forehead than the lower face, and considering surfaces of 4 and 6 together, a general "dished out" effect is produced.

Figure 13:
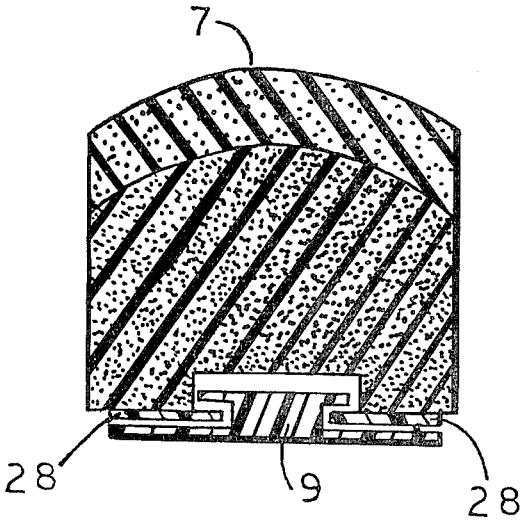
FIG. 13 is a sectional view along line D—D of FIG. 1 showing attachment of shoulder rest 7 to member 9.
Figure 15:
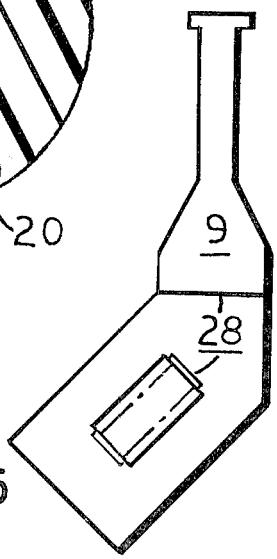
FIG. 15 is a plan view of members 9 and 28.

FIG. 13 is a sectional view along line D—D of FIG. 1 showing attachment of shoulder rest 7 to member 9. Member 28 is fastened to rest 7 as by an adhesive. Member 28 completely surrounds recessed area of member 9 as shown in FIGS. 13 and 15 with 1/16th inch clearance which allows rest 7 to rotate through an arc of forty degrees about a vertical axis. FIG. 1 shows rest 7 on a 45 degree angle; the above attaching method allows this to change from 20° to one side to 20° to the opposite side.

Figure 14:
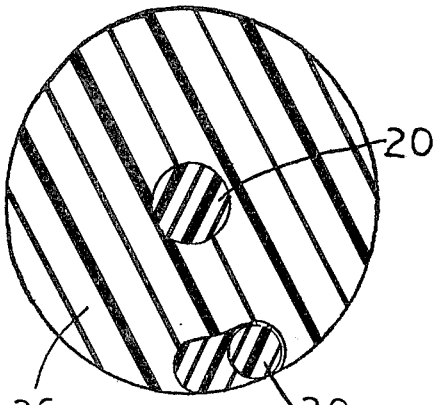
FIG. 14 is a sectional view along line E—E of FIG. 9 showing means of rotating head rests 4 and 6 about a horizontal axis.

FIG. 14 is a sectional view along line E—E of FIG. 9 and shows rotateability of head rests 4 and 6 through support member 26. For maximum user comfort, rest 6 should be readily adjustable from a horizontal plane to an angle downward toward the shoulder rests. The downward angle not to exceed 15°, which is controlled by the smaller pin protruding from support 20 and the length of the cutout in the support flange 26.

What is claimed is:

1. An adjustable rest for the head and shoulder portion of the human body comprising:

a. a base member consisting of two inseparable portions that are movable longitudinally and latitudinally in a limited manner relative to each other and rotatable about a vertical axis in a limited manner, b. a pair of laterally spaced apart resilient shoulder support members, adjustably attached to said base member and adapted to support the shoulders of said human body in a predetermined position, c. each of said shoulder members being so attached to allow limited rotational movement around a vertical axis, d. a face support member, rotatable in a limited manner about a horizontal axis, having separate interconnected movable members comprising at least, one for the forehead, configured as a modified "W" and, at least, one for the lower face configured as an inverted, shallow "V", so aligned to provide support for the human head at varying degrees between the vertical and horizontal positions, to the right or left side, providing two surfaces, with one always in reserve, e. said lower face support member adjustably attached providing means to vary distance between said lower face member and forehead member, f. means of adjustably raising the rotatable face support member, aided by the upward pressure of one or more properly positioned springs, to a heighth suitable for support of the human head while the user is lying on his or her right or left side, g. means for varying tension strength of each spring.

2. The device of claim 1, wherein one or more of the resilient support members has an inflatable bladder core of rubber, plastic, or the like and adapted to be filled to various sizes thereof.

3. The device of claim 2 wherein said core is provided with a suitable cover of polyurethane or the like.

4. The device of claim 1 wherein exposed structural surfaces are covered with a resilient material such as polyurethane or the like to protect the user from injury.

* * * * *